United States Patent [19]

Friday

[11] 4,190,348

[45] Feb. 26, 1980

[54] LEAD EDGE TRANSFER SWITCHING

[75] Inventor: Bruce W. Friday, Webster, N.Y.

[73] Assignee: Xerox Corporation, Stamford, Conn.

[21] Appl. No.: 948,069

[22] Filed: Oct. 2, 1978

[51] Int. Cl.[2] ..... G03G 15/16; H01T 19/04

[52] U.S. Cl. ..... 355/3 TR; 250/325; 355/3 CH; 361/235; 430/126

[58] Field of Search ..... 355/3 R, 3 CH, 3 SH, 355/3 TR; 250/324, 325; 361/229, 235; 96/1 C; 271/DIG. 2

[56] References Cited

U.S. PATENT DOCUMENTS

| | | | |
|---|---|---|---|
| 3,970,381 | 7/1976 | Meagher et al. | 355/3 R |
| 4,027,960 | 6/1977 | Ladrigan | 355/3 R |
| 4,076,407 | 2/1978 | Place | 355/3 TR X |
| 4,077,709 | 3/1978 | Borostyan et al. | 355/3 TR |

*Primary Examiner*—Fred L. Braun

[57] ABSTRACT

In an electrostatographic copying apparatus in which the imaging material is transferred to the copy member by electrical transfer members which leave electrostatic charges on the copy member resisting stripping of the copy member from the original image support surface, and in which a detacking corona generator is provided to partially neutralize those charges before the stripping of the lead edge of the copy member. There is provided an automatic switching system to apply a non-uniform increased transfer charge to the lead edge area of each copy member in comparison to the body of the copy prior to the detacking to improve the effective image transfer to the lead edge area of the copy after stripping. This is preferably provided by a transient over-shoot in the ouptut voltage of a constant current power supply for the transfer members for the lead edge.

14 Claims, 3 Drawing Figures

LEAD EDGE TRANSFER SWITCHING

This invention relates to the electrical transfer of imaging material from an initial image support surface to a copy member in an electrostatographic copying apparatus, and more specifically to a system for improving transfer to the lead edge area of the copy member to be stripped from the initial image support surface.

In electrostatographic copying, the problems of successful and inefficient electrical transfer of the imaging material from the initial support surface to the final copy sheet are well known. In, for example, xerography, the imaging material is typically a readily disturbable powdered toner which is only stabilized by fusing to the copy sheet after the copy sheet has been stripped from a photoreceptor surface.

It is known that very high level transfer fields are desired for efficient electrostatic transfer of the imaging material to the copy sheet, e.g., U.S. Pat. No. 4,027,960. However, it is also known that leaving transfer charges on the copy sheet causes difficulty in stripping the copy sheet from its supporting surface, and that to assist stripping, these charges should desirably be neutralized, e.g., U.S. Pat. No. 3,998,536. It is further known that it is particularly desirable that these neutralizing (electrostatic detacking) charges be higher at the lead edge of the copy member to assist in stripping, e.g., U.S. Pat. No. 3,970,381. However, it is also known that the ultimate transfer efficiency is reduced by the detacking, and other undesirable effects such as image washout in the lead edge area and increased instability of the unfused transferred image can result from excessive electrostatic detacking.

Structures for providing additional electrical fields in the stripping and post-stripping areas can be provided, such as electrodes variably electrically biased with distance, e.g., U.S. Pat. No. 3,647,292, or non-electrostatic mechanical or pneumatic stripping systems may be provided, but they add various known cost, complexity, contamination, image loss, or other disadvantages.

It is additionally known that it is generally desirable to normally maintain the output of the electrostatic transfer device power supply as uniform as possible for each copy member as by a constant current source, e.g., U.S. Pat. Nos. 3,860,436, 3,781,105 and 3,950,680, for uniformity of image density, etc. Changing the transfer level between copy members or sides thereof is also known, e.g., U.S. Pat. No. 4,076,407.

The resolution of these conflicting desires in commercial electrostatic apparatus can result in undesirable compromises, such as the sacrifice in transfer efficiency and quality of the lead of the copy relative to the body of the copy in order to achieve more reliable stripping.

The present invention provides an apparatus and process by which higher transfer efficiencies and better image transfer can be achieved for the lead edge of the copy sheet, more uniform with the transfer efficiency achieved for the body of the copy sheet, yet still provide for a high detacking level for the lead edge of the sheet for the good lead edge stripping characteristics. As disclosed herein, a relatively increased transfer charge is applied to the lead edge area of the copy member to provide a substantially increased electrostatic transfer field to that area in proportion to the remainder of the copy member, prior to the copy member being effectively neutralized for stripping in the lead edge area by the detacking corona generator.

Other features and advantages of the present invention pertain to the particular apparatus and steps whereby the above-mentioned and other aspects of the invention are attained. Accordingly, the invention will be better understood by reference to the following description and to the drawings forming a part thereof, wherein.

Figure 1:
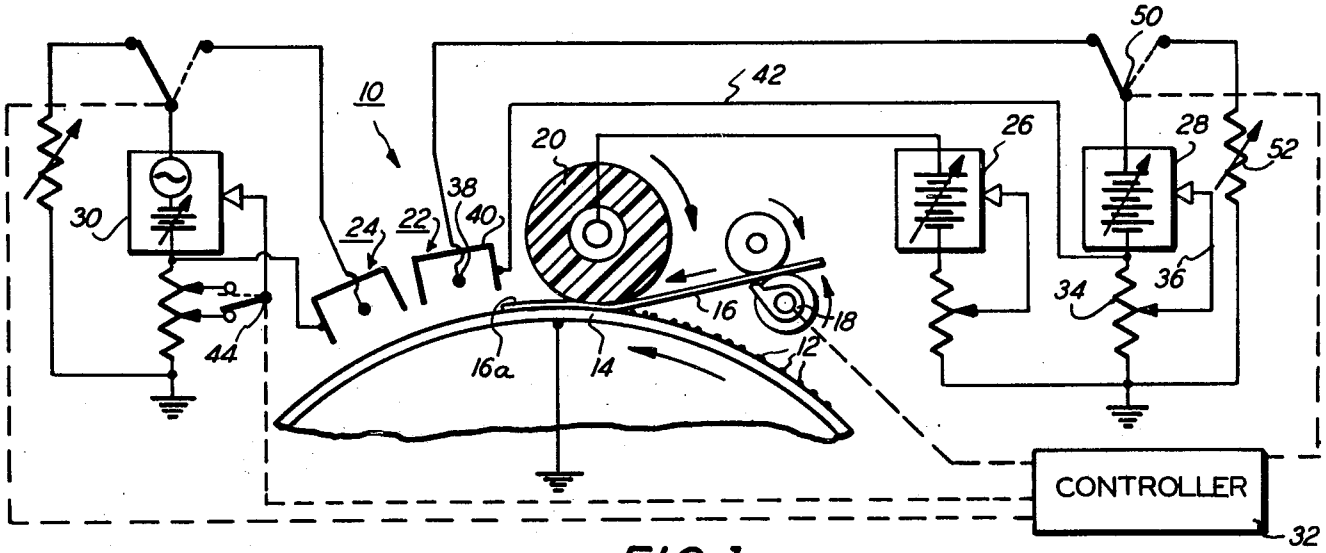
FIG. 1 is an exemplary xerographic transfer station embodiment in accordance with the present invention.

Referring first to FIG. 1, there is shown a transfer station 10 as one example of the present invention. This particular example is an environment similar to that disclosed in U.S. Pat. No. 4,027,960, issued June 7, 1977 to J. W. Ladrigan. However, it will be appreciated that the present invention is applicable to many different types of electrical image transfer systems, such as many of those shown in the other patents cited herein.

In the transfer station 10, a previously developed image of toner 12 or other imaging material is tranferred from its initial supporting surface, here a photoreceptor 14, to a copy sheet 16, which moves through the transfer station 10 with the photoreceptor 14. After passing through the transfer station the copy sheet 16 is then conventionally stripped off of the photoreceptor, lead edge **16*a* first. The lead edge 16*a* of the copy sheet is registered before its entrance into the transfer station at a conventional registration gate 18**.

In this transfer station 10, the copy sheet 16 first passes under a biased transfer roller 20 which presses it into positive engagement with the surface of the photoreceptor 14. The copy sheet 16 then passes under a transfer corotron or other corona generator 22, and then under the adjacent detack corotron or other corona generator 24, before stripping from the curved surface of the photoreceptor 14. The transfer roller 20 is electrically biased to generate image transfer fields by its power supply 26. The transfer corotron 22 is provided with a high voltage supply 28 for the generation of a corona emission current to provide electrostatic transfer fields between the photoreceptor 14 and the copy sheet 16 to achieve maximum transfer of the toner 12 therebetween. In this embodiment, as further described in the above-cited U.S. Pat. No. 4,027,960, the transfer fields provided by the transfer corotron 22 are in addition or supplemental to those provided by the biased transfer roller 20.

The detack corona generator 24 is connected to a power supply 30 for providing alternating current, DC biased, neutralizing corona emissions, to neutralize, at least partially, the transfer charges which were deposited on the copy member by the transfer corotron 22 and the transfer roller 20, to assist in the stripping of the lead edge **16*a* of the copy member 16 from the photoreceptor 14** in a known manner. As is known, if these electrostatic transfer charges on the copy member were not neutralized they would generate forces electrostatically resisting the stripping of the copy sheet from its support surface.

The above-cited U.S. Pat. Nos. 3,998,536, 3,970,381, 4,076,407, etc., and the art discussed therein, provide illustrations and further discussions of these transfer and detack functions and structures and demonstrate that they are sufficiently known to those skilled in the art not to require further discussion herein.

The conventional machine controller 32 here may be a simple timing switching system responsive to the registration 18 of the copy sheet 16 to operate the novel switching functions to be further described herein, as illustrated by the dashed lines. However, preferably the controller 32 will be a partial function of an overall known copy machine controller. Some examples are described and cited in U.S. Pat. Nos. 4,062,061, 3,940,210, and 3,936,182; and U.S. Pat. No. 4,144,550, based on application Ser. No. 829,014 filed Aug. 30, 1977. Any suitable controller or switching arrangement may be utilized.

Referring now to the power supplies 26, 28, and 30 of FIG. 1, these power supplies are shown here schematically for clarity. They are preferably of the constant current type, to provide a constant output current independent of the variations in the impedance or shield current of the corona emitting devices. Examples of such power supplies are disclosed, for example, in the above-cited U.S. Pat. Nos. 3,781,105, 3,860,436 (FIG. 2), and 3,950,680. It will be appreciated that various other constant current high voltage power supplies may be utilized, including various commercially available units includng those in use in xerographic copiers. Other patents illustrating corona power supplies for regulating and/or switching the output of the corona emissions include U.S. Pat. Nos. 3,604,925, 3,688,107, 3,699,388, etc. As with the other structures and functions described herein, it will be noted that various other cited references, technical descriptions and technical background and alternative structures are discussed in these and the other patents cited herein, and all this material is also incorporated by reference herein to the extent appropriate.

Referring now initially to the transfer corotron power supply 28 providing the transfer charges from the transfer corotron 22, it is of the type described in the above-cited U.S. Pat. No. 3,950,680. An electrically floating variable voltage constant current power supply is connected to electrical ground through a ground path resistor 34. A feed-back path 36 variably connects with this ground path resistor to feed back a voltage control signal proportional to the current through the ground path resistor 34 to control the voltage output of the power supply, i.e., to maintain a constant current through the ground path resistor 34. The output of the power supply 28 normally connects to the corona emitting wire or other corona electrode 38 of the transfer corotron 22. As this is here a conventional uncoated wire, the total current provided from the power supply 28 to the transfer electrode 38 divides into two variable current paths. One current path is from the electrode 38 toward the photoreceptor 14, the backing of which is electrically grounded to complete the current loop through the ground path resistor 34. The other current path is from the electrode 38 to the shield 40 of the transfer corotron. As described in U.S. Pat. No. 3,950,680, this shield current is returned in a separate shield current return path or lead 42 to the low side of the power supply 28, i.e., between the ground path resistor 34 and the power supply, rather than directly to ground. This provides a dynamic subtractive measuring and control system as disclosed in said patent which effectively subtracts the shield current from the control loop for the constant current source because the shield current path is not passed through the resistor 34. Thus, the transfer corotron power supply 28 output responds to, and maintains constant, the plate current from the electrode 38 toward the photoreceptor 14, irrespectively and independently of variations in the current to the shield 40. As shown, this same arrangement is also utilized here with the detack corotron power supply 30. Note that the use of a plastic shield for detack would mean zero D.C. shield current and hence eliminate the need for that shield feedback.

It is important to note that the output current, and therefore the applied charge, of the transfer corotron 22 is substantially influenced by the pre-existing electrical field and capacitance between it and the grounded substrate of the photoreceptor 14. Thus, when the copy sheet 16 passes under the transfer corotron, among other effects, there is a change in this effective capacitance, corresponding to the dielectric properties of the particular copy sheet's thickness and material. There is also usually a different photoreceptor charge in the area under the copy sheet. The output current of the transfer corotron will correspondingly change, and that change is corrected by a change in output voltage of the constant current power supply 28. However, this correction cannot be instantaneous, as will be discussed later. In the particular embodiment of FIG. 1, there is also a pre-existing transfer charge on the copy sheet due to the previous transfer fields applied by the high voltage bias transfer roller 20 which can further influence the output of the transfer corotron.

Referring now to the detack corotron 24 and its power supply 30, the exemplary power supply and control system in FIG. 1 is generally similar to that described for the transfer corotron. However, the desired detack corona output is predominately an alternating current, which is DC biased to shift somewhat the net polarity of an unbiased corotron, as described, for example, in the above-cited U.S. patents such as U.S. Pat. No. 3,998,526. It is also desirable to provide a system for switching the output of the detack corotron 24 through the controller 32 in response to the entering of the lead edge of the copy sheet thereunder so that a substantially higher detack or transfer charge neutralization will occur at the lead edge of the copy sheet to assist in the initial stripping of that lead edge from the photoreceptor, as described in the abovecited U.S. Pat. No. 3,970,381.

As one additional example of how this switching may be accomplished, there is shown in FIG. 1 a detack level switch 44 for switching the connecting level to the ground path resistor for this power supply 30. It changes the feed-back level in the feed-back path for controlling the output of the DC bias voltage superimposed on the AC output of this power supply that shifts the level or magnitude of the effective detacking, i.e., provides a greater net neutralization of the transfer charge on the copy sheet in one position of switch 44 for the lead edge, and a lower net neutralization output in the other position of the switch 44 for the rest of the copy sheet.

It will be appreciated however, that various other power supplies may be used for the detack corotron. For example, a regulated or constant current source may not even by required. If the photoreceptor 14 is sufficiently sharply arcuate (has a sufficiently small radius of curvature) at the stripping point, switch of the level of the detack output for the lead edge is not necessary. In fact the entire detack system may be eliminated in some such cases, such as where a sufficiently small stripping radius or a positive mechanical or pneumatic stripping system is provided.

However, it will be appreciated that the present system is particularly desirable in those systems in which the detack corona generator emits a high neutralizing charge current for the lead edge than for the body of the copy sheet, because this further aggravates the difficulty in achieving a uniform, stable and efficient image transfer to the lead edge area of the copy sheet in contrast with the remainder of the copy sheet.

It will be appreciated that the actual current and voltage ranges, polarities, and nominal settings will depend on the specific transfer system components, photoreceptors, imaging materials, copy members, and conditions, and are not specifiable in the abstract. Desirable field levels are known in the art for specific applications, e.g., the cited U.S. Pat. No. 4,027,960 describes transfer fields of 27 to 60 volts per micron for that system.

It has been discovered that, even with a constant (unswitched) detack level, and constant current transfer power supplies, that the peak transfer field level acting on the lead edge area of the copy sheet tends in some systems to be non-uniform and lower than the peak transfer level achieved for the body of the copy sheet. Correspondingly, the transfer efficiency tends to be lower for the lead edge for the body of the copy sheet. One known factor is the tendency for the lead edge of the copy sheet to sometimes be curled away from the photoreceptor. Additionally, charge scattering to the photoreceptor can also reduce the effective transfer fields near the lead edge. However, it has now been discovered that a further and significant factor in lead edge image loss or degradation is the effect of the constant current power supplies for the transfer charging devices having an inherent pre-set or pre-determined finite response time. The transfer power supplies 26 and 28 here, in holding their outputs to a constant current, hold their voltage level outputs to a lower level in the absence of a copy sheet than in the presence of a copy sheet, for the reasons described. As the lead edge of the copy sheet passes under the transfer roller 20, and then the transfer corotron 22, their respective power supplies 26 and 28 will be initially at this lower voltage level. Thus, their effective output currents to the copy sheet will drop initially due to the effect of the copy sheet on their output. The power supplies 26 and 28 will respond automatically to this current drop by raising their voltages, as described. However, due to their finite response time, their current outputs will not respond until after an area of the lead edge of the copy sheet already has a lower transfer charge applied thereto, and therefor a lower peak transfer field. It has been found that the ultimate transfer efficiency, i.e., the percentage of imaging material remaining transferred, is partially a function of the maximum transfer field to which any given area of the copy sheet/photoreceptor sandwich is subjected at any time during the entire transfer process, even if this field is much lower subsequently, e.g., during stripping. If the lead edge of the copy sheet is not, due to the response time of the power supplies, subjected to as high a peak of transfer field level as the body of the copy sheet at any time during transfer, then it will tend to have a different and lower transfer efficiency than the remainder of the copy sheet.

The present invention overcomes the above-described and other problems of the non-uniformity of transfer for the lead edge of the copy member by an automatic switching system which actually provides an increased, rather than decreased, peak transfer field to the lead edge area of the copy member compared to the following areas of the copy member. As disclosed herein, novel transfer switching means applying a non-uniform, increased, transfer power supply voltage for the transfer corona generator for the lead edge area of the copy member provides an increased transfer charge to the lead edge area in proportion to the remainder of the copy member. This is done automatically prior to the copy member being subjected to the output of the detacking corona generating means, and can provide a significant improvement in the relative efficiency of transfer of imaging material to the lead edge area of the copy member. Additionally, as further disclosed, this may be done in coordination and cooperation with the applying of increased detack neutralizing charges to the same lead edge area in proportion to the remainder of the copy member, and in proportion to the magnitude of the increase in transfer charges which are applied to the lead edge area.

It has been found that even though the peak applied transfer charges and the subsequent peak applied detack charges are both increased for the lead edge area, so that the residual transfer charges remaining on the copy sheet at or during stripping are the same, or lower, than for previous systems, that nevertheless, transfer efficiency for the lead edge area is improved. Specifically, it has been found that the transfer efficiency is a function of both the peak transfer field applied during transfer as well as the transfer charge remaining on the copy member at stripping. It is believed that the higher peak transfer fields applied before detacking result in the transfer of a higher percentage of imaging material which is "permanently" transferred, i.e., a substantial percentage of this initially transferred toner does not retransfer back to the photoreceptor, and remains attached to the copy member during and after stripping, even if the lead edge area is also subjected to higher detacking emissions which effectively eliminate almost all of the transfer charge on the copy sheet before or during stripping.

Figure 2:
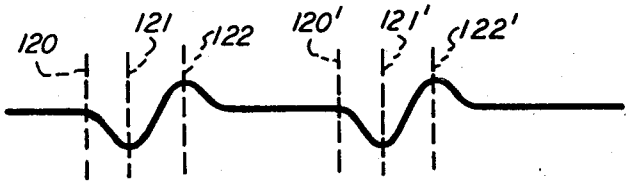
FIG. 2 illustrates an example of the transfer power supply voltage waveform provided in the embodiment of FIG. 1.

Referring to the FIGS. 1 and 2 embodiment of the transfer switching means for applying the increased non-uniform transfer charge to the lead edge area of a copy member, this switching means provides a transient over-shoot in the output of the constant current power supply 28 to the transfer corotron 22 for the lead edge of the copy member. This output variation is illustrated in FIG. 2, which shows the transfer corotron power supply 28 voltage level over a time and distance period corresponding to two successive copy sheets passing through the transfer station. These two successive identical cycles will be described here with respect to one set of transition points or positions 120, 121, 122, for one cycle, but applies equally to the next set, 120', 121', and 122', respectively.

Position 120 here corresponds to the passage of the *trail* edge of the copy sheet past the charging area of the transfer corotron 38. At this point a transfer level switch 50 normally connecting the transfer constant current power supply 28 to the transfer corotron electrode 38 is switched to disconnect or interrupt the output of the transfer corotron in the absence of the copy member thereunder. The switch 50 operates to immediately switch the output of the constant current power supply 28 to a dummy load instead. The dummy load here is provided by a variable load resistor 52. Thus, during the inter-document or "pitch" space, in which no portion of any copy member is under the transfer corotron, the transfer corotron is turned off and the power supply therefor is connected to the dummy load 52 instead.

The variable load resistor 52 is pre-set to a desired resistance level which is substantially lower in impedance than the impedance of the transfer corotron 22. Thus, the power supply 28 automatically reacts by lowering its output voltage to regulate constant the output current of the power supply 28, since it is now flowing through the lower resistance dummy load 52. This is shown by the difference in voltage levels between positions 120 and 121 in FIG. 2. The transitional slope and spacing between 120 and 121 is due to the above-discussed pre-set voltage regulating response time of the power supply.

If no further copy members are fed to the transfer station, the controller will maintain the transfer switch 50 in its dashed line position connected to the dummy load 52. In that case the power supply 28 would continue to maintain its lower output voltage across load 52 at a constant level corresponding to 121.

As indicated, the ratio of voltage levels between 120 and 121, i.e., between the two positions of switch 50, is controlled by the ratio of the impedance setting of resistor 52 to the impedance of the transfer corotron between its electrode 38 and the photoreceptor 14. This is an important factor, because it determines the initial voltage level condition at 121 of the power supply 28 when the power supply 28 is switched back by the switch 50 to reconnect to the transfer corotron electrode.

This initial voltage level at 121, together with the pre-set voltage regulating response time of the power supply 28, is utilized here to control the magnitude and applied area of increased, non-uniform transfer charges applied to the lead edge area of the copy member in comparison to the remainder of the copy member. A deliberate and controlled transient over-shoot of the voltage output of the power supply 28 is generated and applied so that the peak of this over-shoot coincides with the lead edge of the copy sheet entering the field of the transfer corotron, so that a peak transfer field is applied to the lead edge of the copy sheet which is substantially higher than the transfer field applied to the remainder of the copy sheet. Referring to FIG. 2, the lead edge of the copy sheet is subjected to this peak transfer voltage from the power supply 28 at 122. This voltage over-shoot smoothly transitions downwardly from 122 to a decreased and uniform output level for the remainder of the copy member, and until the subsequent cycle, as shown.

Referring to both FIGS. 1 and 2, the controller 32 knows from the registration gate 18 operation when the lead edge of a copy sheet is entering the transfer station. It operates to switch the transfer switch 50 at a position in time (121 in FIG. 2) slightly before the lead edge of the copy sheet enters the charge depositing area of the transfer corotron 22. That is, the transfer corotron is re-connected to its power supply 28 at a time period in advance corresponding to the voltage regulating response time of its power supply. Thus, just before the lead edge enters under the transfer corotron, as shown approximately in the sheet position in FIG. 1, the transfer power supply 28 has regulated its output voltage upwardly to compensate for the decreased current flow due to the higher impedance of the transfer corotron. In the process, as is inherent in such a regulation system subject to a sudden change in load, the power supply 28 over-shoots or overcompensates to raise its output voltage level to a peak at position 122 which is greater than the voltage level required to maintain the current constant to the transfer corotron. By thus deliberately positioning in time this transient voltage over-shoot to coincide with the approaching lead edge of the copy sheet, a corresponding transient transfer current over-shoot in excess of the regulated current level is applied to the lead edge area of the copy sheet. That excess transfer current provides an increased transfer charge. It immediately thereafter begins to decrease back to the regulated level in accordance with the response time of the power supply, as indicated. However, the finite response time produces a corresponding finite transitional area of intentional over-charging of the lead edge.

The above-described circuit and process inherently compensates for the previously described normal and disadvantageous under-charging response of the transfer system to the increased capacitance of the copy sheet lead edge entering the transfer system. Thus, while FIG. 2 illustrates the voltage level output of the power supply 28, the actual transfer fields supplied to the copy sheet are more nearly uniform between the lead edge and the body of the copy sheet. Further, in the absence of the above-described transfer level switching system, the power supply voltage level output would be increasing from the lead edge to compensate for the introduced copy member capacitance, rather than decreasing from an induced transient as provided here.

It may be seen that the compensatory tailored response provided by the above-described system makes use of the inherent characteristics of existing power supplies, and requires only the addition of a simple switch and adjustable resistive load, the timing of which is coordinated from existing machine controller functions. The switching of the power supply from the transfer corotron to a dummy load when image transfer is not required has the additional advantage of reducing ozone production. Yet, the power supply 28 itself is preferably not turned off, which could cause much larger and longer transient conditions and put greater operating demands on the switch 50. The difference in levels between the two connection points of the switch 50 here are relatively small. Capacitance or other conventional switch transient protection can, of course, also be provided.

Briefly reviewing the above-described system 10 of FIG. 1 functionally, as the copy sheet 16 enters the system, the release of the copy sheet lead edge by the registration gate 18 can be used to start the conventional timing and control circuitry 32, typically driven from switches or pulses actuated by the corresponding movement of the photoreceptor 14. With this timing, the power supplies 26, 28, and 30 can all be turned on at the appropriate times to provide their desired outputs before or as the copy sheet approaches their respective connecting components in the transfer path. Specifically, the power supply 28, previously turned on, has its output switched from the dummy load 52 to its corona emitting electrode 38 at the illustrated position just before the lead edge reaches the transfer corotron 22. The controller 32 then can correspondingly switch the output of the detack power supply 30 between the dummy load and its electrode to provide a similar transient increase in the output detack emissions applied at the lead edge of the copy sheet. Alternatively, or additionally, the detack level switch 44 can be operated to provide this function of increasing the neutralization of transfer charges in the lead edge compared to the body of the sheet. The switch 44 will be switched back to its normal position after the lead edge area has passed under the detack corotron 24. As the lead edge passes further through the field of the detack corotron 24, it will either self-strip from the photoreceptor 14 due to the curvature of the photoreceptor and the detacking or, as described, further pneumatic or mechanical stripping means (not shown) may be employed in a known manner.

The stripping system or the subsequent sheet transport may, if desired, cause the stripping point for the body of the copy to shift upstream under the detack corotron relative to the initial stripping point. Stripping during, or before, detack systems are disclosed in U.S. Pat. No. 4,058,306 and the references cited in that patent. Also noted in that regard is Xerox Disclosure Journal, Vol. 2, No. 5, September/October 1977, pages 79–80. Such systems can further increase the desirability of increased lead edge transfer efficiency by increasing the residual transfer charges on the body of the copy member during stripping relative to the lead edge.

As an alternative embodiment it will be appreciated that the desired transient response might also be provided by employing a dummy load resistor 52 which is higher in impedance than the transfer corotron. In that case, the transfer switch 50 would be switched at the point 122 corresponding to the entrance of the lead edge. The higher voltage level, to which the power supply 28 would have then regulated to this higher dummy load 52 impedance, would be applied to the transfer corotron as the lead edge enters its field, to provide a transient excess current output for the lead edge area.

In this alternative embodiment, the voltage wave shape would differ from FIG. 2 in that from point 120 corresponding to the trail edge of the copy sheet, the power supply voltage would rise up to a higher, not lower, level at 122 and remain there until position 122, when switch 50 would be actuated. However, this alternative embodiment is less preferred, in that it is preferable to connect or turn on the transfer corotron at 121, i.e., substantially before the lead edge of the copy member is to be charged, to allow for the finite response time and capacitance effects of the corona generator itself.

As another alternative, it will be appreciated that, rather than switch the output of the power supply between the transfer corotron and a dummy load, that the power supply 28 can be switched in output current level by various other suitable known switching means, such as by switching between different internal bias or regulating voltage levels within the power supply, or by switching the position or resistance level of the current feed-back loop. The latter is shown for the detack level switch 44, where there is provided an additional switch for adding or subtracting resistance to the current regulator resistor in series (or parallel) at the appropriate time in coordination with the position of the copy sheet lead edge.

It will be appreciated that with the present system the transfer corotron should be spaced close in positon and time to the detack corotron in the paper path to avoid the leakage along the copy member of the higher level edge transfer charges applied by the present system. However, such close spacing is conventionally provided in xerographic systems already.

It may be seen that with the above-described system, that the output current of the transfer corotron power supply is deliberately made non-uniform, even though that is contrary to the conventional teaching that the transfer charging be as uniform as possible, preferably by using a constant current source. Further, with the present system the transfer charges applied to the lead edge are greater than those applied to the copy body, whereas conventional teaching would indicate that this would interfere more with stripping of the lead edge of the copy sheet from the photoreceptor or that a much higher detacking would then be required to remove that increased transfer charge. It might be thought that such higher detacking would remove the transfer efficiency benefit of this higher initial transfer field, whereas the opposite has been found to be true i.e., the lead edge area transfer can be improved with the present system without imparing lead edge stripping, and higher detacking levels can be utilized for the lead edge for more positive stripping without a directly corresponding loss of the improved transfer efficiency.

The present system may be particularly desirable for transfers of imaging material comprising very fine (small diameter) particulate dry toner particles, since they can have even more a tendency to be unstable at or during stripping under certain conditions, but can also have a tendency for improved adhesion to the copy member due to Van der Walls or other adhesion forces, even absent residual transfer charges or fields, once their initial transfer from the photoreceptor surface to the copy surface has been initially accomplished by a sufficiently high field.

Figure 3:
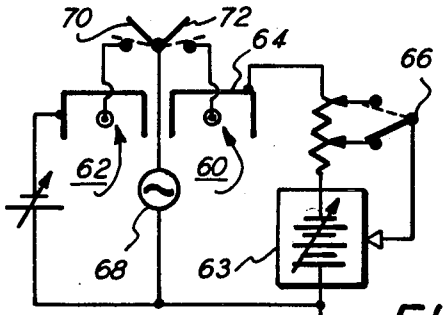
FIG. 3 is an alternative embodiment of the transfer station of FIG. 1, utilizing di-corotrons rather than conventional corotrons.

Referring now to FIG. 3, there is shown an alternative embodiment of the system and circuitry of FIG. 1. In this embodiment, the transfer station consists only of a transfer corona generator 60 and a detack corona generator 62 and their associated power supplies, which are partially shared. That is, there is no bias transfer roller or transfer roller power supply in this embodiment. Instead of using ordinary uninsulated electrode corona generators, as in the embodiment of FIG. 1, the embodiment of FIG. 3 utilized insulated (dielectrically coated) A.C. powered electrodes. These known "di-corotrons" are described in further detail in U.S. Pat. No. 4,086,650, issued Apr. 25, 1978, to T. G. Davis et al..

In a di-corotron, among other advantages, the D.C. output current to the photoreceptor and copy sheet passing thereunder is directly equal and opposite to the shield current. This enables a simpler power supply and control system not requiring a subtractive feed-back path for the shield current in order to accomplish the same control functions. The thick glass or other dielectric coating on the corona electrode blocks any net D.C. flow through the electrode, but allows A.C. corona generation. The D.C. voltage bias on the di-corotrons conductive uninsulated shield causes a D.C. current flow thereto from the corona which causes an equal and opposite net D.C. current flow output from the corona toward the photoreceptor.

The output level of the transfer di-corotron 60 could be switched to generate the desired higher voltage for the lead edge of the copy sheet in a manner similar to that described above for FIG. 1, e.g., the shield current D.C. power supply 63 could be switched intermittently to a dummy load. However, as another example, there is shown in FIG. 3 a switch 66 in the current control resistance feed-back for this D.C. shield power supply 63. Various other suitable switching arrangements could be utilized in coordination with the movement of the lead edge of the copy sheet. However, it is noted that a di-corotron's A.C. corona output is not terminated by interrupting the shield power supply. The A.C. energization of the electrodes of both di-corotrons 60 and 62 may be, if desired, from a common A.C. power supply 68 as shown, independent of the D.C. power supply 63. This A.C. supply 68 can be a constant current supply if desired. If it is desired to interrupt or shut off the output of either of these di-corotrons during the inter-copy spaces, switches 70 or 72 can be opened, as shown, automatically by the controller 32.

The use of a di-corotron for the transfer corona generator is particularly desirable where the transfer charges to be applied are negative rather than positive, since a di-corotron tends to provide a more uniform corona emission along the length of the electrode wire. Also, a simpler constant current control can be provided with di-corotrons. The output current can be measured and controlled at any point in the path of the shield current loop from the power supply 63, including the output side between the power supply and the shield, as shown, because there is no need to feed-back and subtract the shield current from the total electrode current as is shown in FIG. 1. Thus, neither of the power supplies 63 or 68 need be electrically floated above the common electrical ground.

It will be noted that, by way of example, the detack di-corotron 62 in the embodiment of FIG. 3 is operated at a constant initially adjusted, shield D.C. bias level to provide an unregulated D.C. biased A.C. output. Also, it is not switched for the copy lead edge in this particular embodiment.

While the above-described method and apparatus are preferred, it will be appreciated that numerous other variations and modifications of the present invention may be made by those skilled in the art. Accordingly, the following claims are intended to cover all such variations and modifications as fall within the true spirit and scope of the invention.

What is claimed is:

1. In an electrostatographic copying apparatus in which imaging material is transferred from an image support surface to a moving copy member by electrical transfer means including an electrical power supply, which transfer means applies electrostatic fields for said transfer of the imaging material and deposits electrostatic charges on the copy member which electrostatically resist the stripping of the copy member from said image support surface; and in which copying apparatus detacking corona generating means are also provided for at least partially neutralizing said charges deposited on the copy member by said transfer means so as to assist in the stripping of the lead edge of the copy member from said image support surface; the improvement comprising:

transfer switching means for applying a non-uniform increased transfer charge to the lead edge area of a copy member to provide a substantially increased electrostatic transfer field to the lead edge area of the copy member in proportion to the remainder of the copy member, prior to the copy member being subjected to said detacking corona generating means, to improve said transfer of said imaging material to the lead edge area of said copy member.

2. The electrostatographic copying apparatus of claim 1, wherein said detacking corona generating means includes control means for applying increased neutralizing charges to said lead edge of said copy member in proportion to the remainder of said copy member, which increased neutralizing charges are increased in proportion to, but less than, said increase in said increased transfer charges applied to said lead edge area of said copy member.

3. The electrostatographic copying apparatus of claims 1 or 2, wherein said transfer means comprises transfer corona generating means, and said electrical power supply therefor comprises a constant current power supply, and wherein said transfer switching means provides a transient over-shoot in the output of said constant current power supply to said transfer corona generating means for the lead edge of the copy member.

4. The electrostatographic copying apparatus of claims 1 or 2, wherein said transfer means comprises transfer corona generating means, and said electrical power supply therefor comprises a constant current power supply with a given voltage regulating response time, and wherein said transfer switching means provides a transient over-shoot in the output of said constant current power supply to said transfer corona generating means for the lead edge of the copy member by interrupting the output of said transfer corona generating means in the absence of a copy member adjacent said transfer corona generating means and by switching on the output of said transfer corona generating means in coordination with the lead edge area of said copy member adjacent said transfer corona generating means.

5. The electrostatographic copying apparatus of claim 3, wherein said transfer switching means switches said constant current power supply between said transfer corona generating means and dummy load means, said dummy load means being substantially lower in impedance that the impedance of said transfer corona generating means to cause said constant current power supply to raise it output voltage while it is switched from said dummy load in comparison to its normal output voltage to which it is regulated while switched to said transfer corona generating means, to thereby provide said initial transient over-shoot in the output of said constant current power supply for a brief time period after being switched back to said transfer corona generating means corresponding to a desired lead edge area movement of the copy member to which said increased transfer charge is to be applied, which transient over-shoot decreases smoothly from the lead edge down to a uniform output for the remainder of the copy member.

6. The electrostatographic copying apparatus of claim 4, wherein said transfer switching means switches said constant current power supply between said transfer corona generating means and dummy load means, said dummy load means being substantially lower in impedance than the impedance of said transfer corona generating means to cause said constant current power supply to raise its output voltage while it is switched from said dummy load in comparison to its normal output voltage to which it is regulated while switched to said transfer corona generating means, to thereby provide said initial transient over-shoot in the output of said constant current power supply for a brief time period after being switched back to said transfer corona generating means corresponding to a desired lead edge area movement of the copy member to which said increased transfer charge is to be applied, which transient over-shoot decreases smoothly from the lead edge down to a uniform output for the remainder of the copy member.

7. The electrostatographic copying apparatus of claim 5 wherein, said dummy load means is variable resistance means for controlling the magnitude and applied area of said increased transfer charges applied to the lead edge area of the copy member.

8. The electrostatographic copying apparatus of claim 6, wherein said dummy load means is variable resistance means for controlling the magnitude and applied area of said increased transfer charges applied to the lead edge area of the copy member.

9. In the method of electrostatographic copying in which imaging material is transferred from an image support surface to a moving copy member by electrical transfer means including an electrical power supply, which transfer means applies electrostatic fields for said transfer of the imaging material and deposits electrostatic charges on the copy member which electrostatically resist the stripping of the copy member from said image support surface; and in which copying method detacking corona generating means are also provided for at least partially neutralizing said charges deposited on the copy member by said transfer means so as to assist in the stripping of the lead edge of the copy member from said image support surface; the improvement comprising:

applying a non-uniform increased transfer charge to the lead edge area of a copy member to provide a substantially increased electrostatic transfer field to the lead edge area of the copy member in proportion to the remainder of the copy member, prior to the copy member being subjected to said detacking corona generating means, to improve said transfer of said imaging material to said lead edge area of said copy member.

10. The electrostatographic copying method of claim 9, wherein said detacking corona generating means is controlled to apply increased neutralizing charges to said lead edge of said copy member in proportion to the remainder of said copy member, which increased neutralizing charges are increased in proportion to, but less than, said increase in said increased transfer charges applied to said lead edge area of said copy member.

11. The electrostatographic copying method of claims 9 or 10, wherein said transfer means comprises transfer corona generating means, and said electrical power supply therefor is a constant current power supply, and wherein a transient over-shoot is provided in the output of said constant current power supply to said transfer corona generating means for the lead edge of the copy member to provide said increased transfer charge.

12. The electrostatographic copying method of claims 9 or 10, wherein said transfer means comprises transfer corona generating means, and said electrical power supply therefor comprises a constant current power supply with a pre-set voltage regulating response time, and wherein a transient over-shoot is provided in the output of said constant current power supply to said transfer corona generating means for the lead edge of the copy member by interrupting the output of said transfer corona generating means in the absence of a copy member adjacent said transfer corona generating means and by switching on the output of said transfer corona generating means in coordination with the movement of the lead edge area of said copy member adjacent said transfer corona generating means.

13. The electrostatographic copying method of claim 12, wherein when said constant current power supply is switched between said transfer corona generating means and a dummy load substantially higher in impedance than the impedance of said transfer corona generating means to cause said constant current power supply to raise its output voltage while it is switched to said dummy load in comparison to its normal output voltage to which it is regulated while switched to said transfer corona generating means, to thereby provide said initial transient over-shoot in the output of said constant current power supply for a brief time period after being switched back to said transfer corona generating means corresponding to a desired lead edge area movement of the copy member to which said increased transfer charge is to be applied, which transient over-shoot decreases smoothly from the lead edge down to a uniform output for the remainder of the copy member.

14. The electrostatographic copying method of claim 13, wherein said dummy load is a variable resistance means which is varied to control the magnitude and applied area of said increased transfer charges applied to the lead edge area of the copy member.

* * * * *